United States Patent [19]

Joschko et al.

[11] 4,133,145

[45] Jan. 9, 1979

[54] METHOD FOR PRODUCING A GRINDING AGENT CARRIER

[75] Inventors: Günter Joschko; Peter Albrecht, both of Berlin, Fed. Rep. of Germany

[73] Assignee: TED Bildplatten Aktiengesellschaft AEG-Telefunken-Teldec, Zug, Switzerland

[21] Appl. No.: 788,959

[22] Filed: Apr. 19, 1977

Related U.S. Application Data

[63] Continuation of Ser. No. 750,634, Dec. 15, 1976, abandoned.

[51] Int. Cl.[2] ..... B24D 11/02

[52] U.S. Cl. ..... 51/295; 51/298 R; 51/309 R

[58] Field of Search ..... 51/309, 295, 293, 298

[56] References Cited

U.S. PATENT DOCUMENTS 3,485,608 12/1969 Cecil ..... 51/293

3,985,521 10/1976 Borchard et al. ..... 51/295

FOREIGN PATENT DOCUMENTS 2312149 9/1974 Fed. Rep. of Germany ..... 51/295

*Primary Examiner*—Donald J. Arnold

*Attorney, Agent, or Firm*—Spencer & Kaye

[57] ABSTRACT

A process is provided for producing a grinding agent carrier comprised of a carrier body and a layer of grinding agent on the surface of the carrier body. The grinding agent layer is initially produced on a planar substrate by sedimentation from a suspension comprised of a suspension medium and grinding agent, and the grinding agent layer is then transferred from the substrate and bonded to the carrier body. The substrate is maintained in a horizontal position and the sedimentation is effected on the horizontal substrate from a liquid column of the suspension wherein the liquid column has a height in millimeters which is at most around 0.4 times the square root of the width in millimeters of the liquid column.

17 Claims, 4 Drawing Figures

METHOD FOR PRODUCING A GRINDING AGENT CARRIER

CROSS-REFERENCE TO RELATED APPLICATION

This application is a continuation of application Ser. No. 750,634, filed Dec. 15th, 1976, now abandoned and hereby incorporated by reference.

BACKGROUND OF THE INVENTION

The present invention relates to a method for producing a grinding agent carrier comprised of a carrier body and a layer of grinding agent on the surface of the carrier body.

Grinding agent carriers, in the form of a plastic grinding foil as a carrier body having an embedded grinding agent uniformly distributed over its surface and pressed thereinto, have been used to grind cutting styli and pickups for information carriers. Grinding foils, a method for profile grinding a mechanical signal scanner, and a device for practicing the grinding process are all disclosed in German Offenlegungsschrift No. 2,053,866. To practice this profile grinding method, a flexible plastic foil is used which should have a thickness, for example, of about 100μ and whose surface contains grooves with a certain profile which corresponds to the desired shape of the pickup to be ground and a grinding agent finely distributed and embedded in its surface, for example, diamond powder.

Grinding foils are also used in the profile-free grinding of cutting styli which are used to cut modulated signal grooves into lacquer foil as preliminary stages for video or audio records. The grinding foils for use in profile-free grinding are flexible plastic grinding discs having a planar, unprofiled surface which is also provided with an embedded grinding agent.

As has been found in practice, the grinding foils for the intended purpose must meet considerable requirements, particularly with respect to uniformity of distribution of the grinding agent embedded in the surface of the grinding foil. The uniformity of the grinding agent layer is of particular significance if a grinding agent carrier is to be produced which is to have only a single layer of grinding agent as disclosed, for example, in German Offenlegungsschrift No. 23 50 732.

In German Offenlegungsschrift No. 23 12 149, which is hereby incorporated by reference, there is disclosed a method for producing a grinding agent carrier including a carrier body which is provided on its surface with a layer of grinding agent, such as diamond powder, by forming the layer of grinding agent on a planar substrate by sedimentation from a grinding agent suspension and then transferring the so-formed layer from the planar substrate and bonding it to the carrier body. In one embodiment of the method disclosed in German Offenlegungsschrift No. 23 12 149, the grinding agent layer is applied directly by sedimentation onto the carrier body as the planar substrate so that a transfer from the otherwise employed auxiliary substrate to the carrier body to be coated is eliminated. In the method disclosed in German Offenlegungsschrift No. 23 12 149, the edges of the planar substrate are provided with edge limitation means to prevent the suspension from running off the planar substrate, but the use of such edge limitation means can lead to inhomogeneities in the edge zone of the grinding agent layer. Further, in the method in German Offenlegungsschrift No. 23 12 149, after the suspension is applied to the planar substrate, the suspending medium is removed by such means as sucking away, siphoning off, or by evaporation, and the transfer of the grinding agent layer to the carrier body is done by the use of a press heated to temperatures in the range of, for example, 150 to 170° C.

SUMMARY OF THE INVENTION

A primary object of the present invention is to provide a method for producing a grinding agent carrier which has a layer of grinding agent which is as uniform as possible.

A further object of the present invention is to provide a method for producing a grinding agent carrier having a layer of grinding agent which is as uniform as possible by means of the sedimentation process and to improve the method disclosed in the above-referred to German Offenlegungsschrift No. 23 12 149.

Another object of the present invention is to provide a method for producing a grinding agent carrier having a uniform single layer of grinding agent.

A still further object of the present invention is to provide a grinding agent carrier wherein the grinding agent is homogeneously distributed and embedded in the surface with a sufficient degree of fill and satisfactory adhesion.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, as embodied and broadly described, the present invention provides a process for producing a grinding agent carrier comprised of a carrier body and a layer of grinding agent on the surface of the carrier body, the grinding agent layer being initially produced on a planar substrate by sedimentation from a suspension comprised of a suspension medium and grinding agent and then transferred from the substrate and bonded to the carrier body, comprising: maintaining the substrate in a horizontal position, and effecting the sedimentation on the horizontal substrate from a liquid column of suspension in which the liquid column has a height in millimeters which is at most around 0.4 times the square root of the width in millimeters of the liquid column. The height of the liquid column can be less than one-tenth of its width.

It has been found that the last phase of drying of the liquid column is decisive for the quality of the grinding agent layer on the planar substrate. It is therefore not necessary nor advisable to sediment from a high liquid column but it is better to effect the sedimentation onto the planar and horizontally disposed substrate in but a thin layer, for example in the form of a puddle. The sedimentation is then effected exclusively by evaporation so that no other measures are required to remove the suspension medium. Malfunctions produced by sucking away the excess of suspension medium or similar methods are thus eliminated.

The uniformity of the resulting grinding agent layer can additionally be improved by effecting the evaporation in a quiescent atmosphere.

Since the evaporation speed also influences the uniformity of the grinding agent layer, a suspension medium is advisably selected which is volatile at room temperature in the same order of magnitude as ethanol. The sedimentation is then effected approximately at room temperature.

It is to be understood that both the foregoing general description and the following detailed description are exemplary, but are not restrictive of the invention.

BRIEF DESCRIPTION OF THE DRAWINGS

The accompanying drawings, in which like numbers indicate like parts, illustrate an example of a presently preferred embodiment of the invention and, together with the description serve to explain the principles of the invention.

Of the drawings.

DESCRIPTION OF THE PREFERRED EMBODIMENTS

Figure 1:
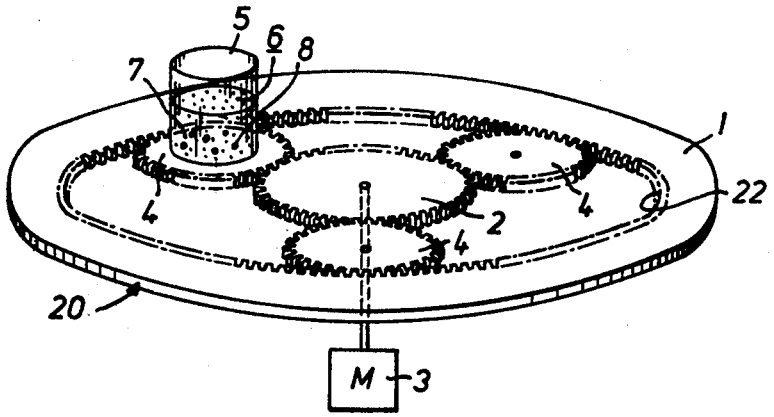
FIG. 1 shows a process step which can be used in the process of the present invention for separating the grinding agent particles in the suspension medium with the aid of planet gears.

In the practice of the present invention, the carrier body for application of the grinding agent layer can advantageously be a foil based on thermoplastic synthetics, such as, for example, polyvinylchloride, which are available as self-supporting foils. The self-supporting foils can possibly be underlined with a stiffening material. Such suitable stiffening materials are, in addition to thicker layers of thermoplastic materials, layers of thermosetting plastic materials, e.g. phenol resin or epoxy resin.

In the practice of the present invention, the layer of grinding agent preferably comprises a layer of diamond powder as the grinding agent, but any other similarly fine-grained grinding agent, for example one based on emery or the like can also be used. The grinding agent is suspended in a suspension medium to form a suspension, and the suspension is then applied to a planar substrate to start the sedimentation process.

For the sedimentation process, it has been found advisable to use a glass plate as the planar substrate onto which the suspension can be applied. Such a substrate combines the advantage of sufficient hardness of the basic material with the possibility of easily producing a planar surface. Moreover, the transparent glass plate permits easy optical monitoring of the uniformity of the applied sediment. In principle, however, other sufficiently smooth substrates of metallic or nonmetallic materials in compact or porous form can also be used for this purpose.

For producing the suspension, easily evaporatable solvents have been found to be particularly advantageous as the suspension medium. A preferred medium for producing a suspension of fine-grained diamond powder has been found to be ethanol which can be easily removed from the sediment at room temperature.

If ethanol is used as the suspension medium, for example, the evaporation speed at 22° C. is just great enough that a uniform layer is produced from a mixture of ethanol and diamond powder having a diamond grain size of 1.5 to 3$\mu$. With too great an evaporation speed, there results heavy turbulences which lead to agglomerations and thinning within the grinding agent layer.

In producing a grinding agent carrier with a substantially single-layer grinding agent coating, it is necessary to select the concentration of the suspension so that with the selected height of the liquid column, a single-layer grinding agent coating is produced. If the sedimentation is effected, for example, from a suspension puddle of 3.3 $cm^2$ with diamond grain sizes between 1.5 and 3$\mu$, 3 to 15 mg, especially 5.7 mg diamond grains should be contained in one milliliter of ethanol in order to obtain a single-layer grinding agent coating.

The uniformity of the grinding agent layer, particularly if it is a single layer, is additionally influenced by the degree of separation of the grinding agent particles in the suspension. It is therefore advisable to provide process steps which separate adhering grinding agent particles from one another. To accomplish this, the grinding agent, for example, diamond powder, can be introduced into an easily volatile liquid, for example ethanol, with the addition of a dispersing and wetting agent, for example, the agent known by the trade name Nekal BX, sold by GAF, Corp. A quantity of 0.3 to 0.5 mg of the powdery Nekal BX per milliliter of ethanol is suitable. Instead of Nekal BX, other agents based upon sodium alkylnapthalenesulfonate may be used. The dispersing and wetting agent serves to perfectly wet the diamond powder with the ethanol. A suspension of these three components, namely, the easily volatile liquid, the grinding agent and the dispersing and wetting agent, is produced in suitable vessels, such as, for example, glass bottles which have been found to be expedient. However, since diamond powder is generally available only in a rather lumpy form, the making of a suspension alone does not result in sufficient separation of the particles of the grinding agent. In accordance with a preferred embodiment of the invention, the vessels containing the suspension are therefore placed, preferably eccentrically, onto the planet gears of a planet gear assembly and are caused to rotate at a minimum speed of 600 rpm for at least one hour. In order to intensify the separation process, a few grains of a granulator are placed into the vessels. For example, a granulator in the form of beads (preferred diameter 1 or 2 mm) made from a plastic material which is softer than the walls of the vessel and which is not soluble in the suspension medium can be used. Such a material can be, for example, a nylon, such as that known by the trade name Rilsan (sold by Aquitaine-Organico GmbH, Dusseldorf, Germany). Harder additives, such as glass or metal balls, would result in undesirable wear at the vessel walls. Experiments have shown that other measures, such as stirring or simple centrifuging do not produce sufficient separation.

After the diamond powder particles are sufficiently uniformly distributed in the suspension the suspension is applied, in the further course of the process, as a liquid column in the form of a puddle onto the planar substrate which acts as a temporary or auxiliary carrier where the ethanol then evaporates, it being advisable to maintain the above-mentioned conditions relating to the use of room temperature and a quiescent atmosphere. In addition to these conditions, it has been found advisable to employ a waterless suspension medium and thus also a waterless dispersing and wetting agent since otherwise striations or streaks will appear on the dry grinding agent layer. The suspension can be transferred to the planar substrate by means of a pipette.

The auxiliary carrier which is employed as the horizontal, planar substrate advisably has a roughness which is adapted to the grain size of the grinding agent. For example, for diamond grains having a grain size of between 1.5 and 3μ, a roughness depth of approximately 0.25μ is applicable which corresponds in the order of magnitude to one tenth of the size of the diamond grains. In the present invention, as explained in detail below, the auxiliary carrier shall not have any raised edge or edge limitation means to maintain the liquid column on the auxiliary carrier. But it is advisable to apply the liquid column in such a manner that it completely extends to the edges of the planar surface of the substrate. Thus the most uniform distribution of the grinding agent over the surface of the substrate can be achieved. The substrate is preferably round or ring-like. When using a ring-like substrate the width of the column is the half difference between the outer and the inner diameter of the ring.

The carrier body can have each suitable shape. The shape of the coated part of the surface of the carrier body can be designed by using a pressing member of a shape which corresponds to the desired shape of the coated part. In addition it is advisable to employ a planar substrate which is a few millimeters larger than the part of the grinding agent layer that is to transfer to the carrier body. Thus those parts of the grinding agent layer at the substrate, which extend near the border of the substrate and which might be less uniform, will not be transferred.

The upper limit for the ratio of width to height is given by the fact that the height must be essentially greater (especially about 100 times greater) than the grain size of the diamond powder and that the width must not be so great than an essential evaporation begins before the suspension is completely applied to the planar substrate.

The preferred range of the height h in millimeters in relation to the width d in millimeters of the column is $0.25 \cdot \sqrt[2]{d}$ to $0.35 \cdot \sqrt[2]{d}$.

Suitable heights of the puddle are 0.3 to 3 mm, using widths of 10 to 100 mm. It is preferred to use a ring-like substrate with an outer diameter of 32 mm and an inner diameter of 15 mm; then the preferred height of the column is 0.9 mm.

Referring now to FIG. 1, there is shown a planet gear assembly, generally 20, which has a stationary outer ring 1 having a set of teeth which extends about the inner periphery 22 of the ring. Planet gear assembly 20 includes a sun gear 2 which is driven by a motor 3 and a plurality of planet gears 4. In the embodiment shown in FIG. 1, planet gear assembly 20 is provided with three planet gears 4. A glass vessel 5 is placed on one of the planet gears 4 and accommodates a suspension 6 comprised of an ethanol suspending medium, a grinding agent 7 of diamond powder, and plastic granulators 8 in the form of beads. Although only one vessel 5 is shown in FIG. 1, each of the planet gears 4 can be provided with a vessel 5.

After the vessel 5 is placed on planet gear 4, the planet gears are then rotated to homogeneously distribute the diamond powder in the suspending medium.

Figure 2:
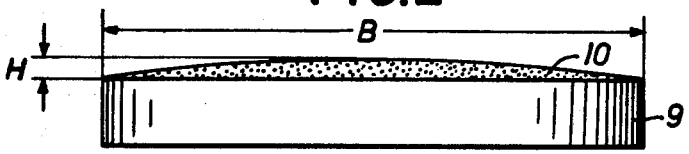
FIG. 2 shows a planar substrate in the form of an auxiliary carrier and a liquid column on the auxiliary carrier in accordance with the teachings of the present invention.

Once the diamond powder has been homogeneously distributed in the ethanol, the rotation of the planet gears is stopped and a required partial quantity of the suspension is removed from vessel 5 by means of a pipette and placed onto an auxiliary carrier 9, shown in FIG. 2. Due to its homogeneous distribution, the diamond powder will be uniformly dosaged. The required quantity of liquid is selected, by means of the appropriate mixing ratio of the diamond powder and the suspension medium, so that the entire surface area of auxiliary carrier 9 will be covered with a liquid column 10 of the suspension in the form of a puddle, but the ethanol will not flow over the edges of auxiliary carrier 9 which would result in flow patterns which might interfere with the homogeneous distribution of the grinding agent in the suspension. Moreover, in this way, it is not necessary to provide an edge limitation for the puddle by means of delimiting walls or dams which can lead to inhomogeneities in the edge zone of the grinding agent layer. Liquid column 10 can be merely constituted by a puddle having a height (H) and a width (B) which is more than 10 times the height (H). During application and drying of the suspension, the auxiliary carrier 9 must be placed perfectly horizontally. Upon evaporation of the suspending medium and settling of the diamond particles on the surface of auxiliary carrier 9, a sediment in the form of a grinding agent layer **10*a* is formed which is homogeneously distributed over the entire surface of auxiliary carrier 9** and has a uniform layer thickness.

Figure 3:
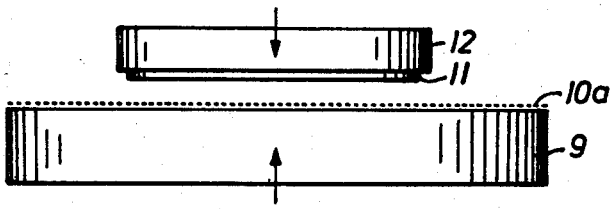
FIG. 3 shows the process step of applying the grinding agent layer from the auxiliary carrier onto the carrier body in accordance with the teachings of the present invention.

After grinding agent layer **10*a* is formed on auxiliary layer 9, it is transferred to a carrier body 11, as shown in FIG. 3, by pressing carrier body 11, which, for example, may be a PVC foil, onto the coated auxiliary carrier 9 with the aid of a pressing member 12 and a pressure of about $20 \times 10^3$ Newton/cm$^2$. Carrier body 11 thus absorbs the diamonds of the grinding agent layer 10*a*, but at such a slight penetration depth that there is produced sufficient adhesion for a single-layer coating of diamond and excess diamonds remain on the auxiliary carrier 9. This effect can be enhanced by effecting the pressing of carrier body 11 without heating it because heating otherwise could affect the unwished softening of the carrier body 11. In this way, possibly existing fluctuations in layer thickness on auxiliary carrier 9 are eliminated during the transfer onto carrier body 11**.

Figure 4:
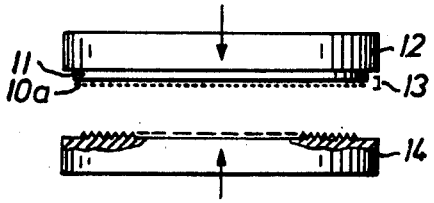
FIG. 4 shows a further step, which can be used in the practice of the present invention, in which a groove profile is impressed into an already reinforced grinding agent carrier.

FIG. 4 finally shows how a grinding agent profile can be pressed into a grinding agent carrier 13 comprised of carrier body 11 and the adhering grinding agent layer **10*a* with the aid of a hot stamping matrix 14. Stamping matrix 14 is pressed under the influence of heat against the pressing member 12 carrying grinding agent carrier 13. Even if no groove profile is desired, it is advisable to press a stamping matrix without a profile against the grinding agent layer 10*a*** under the influence of heat. The temperature may be chosen in the range of around 150° C. to 170° C. and a suitable pressure range is from about 1500 to 2000 Newton/cm$^2$. It is advisable to cool down the grinding agent carrier before the pressure is reduced to atmospheric pressure.

The process according to the invention has the advantage that it permits the production of grinding agent carriers having very uniform grinding agent layers which is of importance particularly for single-layer coats. In addition, it results in a saving of grinding agent because the transfer of the grinding agent layer **10*a* from the auxiliary carrier 9** to the grinding agent carrier body 11 in the cold state prevents accumulations of grinding agent.

It will be understood that the above description of the present invention is susceptible to various modifications, changes and adaptions, and the same are intended to be comprehended within the meaning and range of equivalents of the appended claims.

What is claimed is:

1. In a process for producing a grinding agent carrier comprised of a carrier body and a layer of grinding agent on the surface of the carrier body, the grinding agent layer being initially produced on a planar substrate by sedimentation from a suspension comprised of a suspension medium and grinding agent and then transferred from the substrate and bonded to the carrier body, the improvement wherein the substrate is maintained in a horizontal position and the sedimentation is effected on the horizontal substrate from a liquid column of the suspension wherein the liquid column has a height in millimeters which is at most around 0.4 times the square root of the width in millimeters of the liquid column.

2. Process as defined in claim 1 wherein the suspension medium in which the grinding agent is suspended is removed during sedimentation by evaporation.

3. Process as defined in claim 2 wherein the evaporation takes place in a quiescent atmosphere.

4. Process as defined in claim 2 wherein a suspension medium is employed which is volatile at room temperature in the same order of magnitude as ethanol.

5. Process as defined in claim 2 wherein the sedimentation takes place approximately at room temperature.

6. Process as defined in claim 1 wherein the concentration of the suspension is selected so that at the selected height of the liquid column, a single-layer grinding agent coating is produced.

7. Process as defined in claim 1 wherein the suspension is produced in a vessel with the addition of a granulator which is softer than the walls of the vessel and which is not soluble in the suspension medium.

8. Process as defined in claim 7 wherein a plastic granulator is employed in a glass vessel.

9. Process as defined in claim 7 wherein the vessel for producing the suspension is placed onto a planet gear of a horizontal planet gear assembly.

10. Process as defined in claim 1 wherein the suspension medium contains a dispersing and wetting agent.

11. Process as defined in claim 1 wherein the suspension medium is free of water.

12. Process as defined in claim 1 wherein the substrate used for the sedimentation is an auxiliary carrier from which the sedimented grinding agent layer is transferred to the carrier body by pressing against said carrier body without said carrier body being heated.

13. Process as defined in claim 1 wherein the planar substrate has a roughness depth on its surface adapted to the grain size of the gringing agent.

14. Process as defined in claim 1 wherein a liquid column is employed which is constituted merely by a puddle on the planar surface of the substrate, and said puddle is not restricted along the edges of the substrate by delimiting walls or dams.

15. Process as defined in claim 14 wherein the liquid column completely extends to the edges of the planar surface of the substrate.

16. Process as defined in claim 1 wherein the liquid column has a height which is less than one tenth of its width.

17. In a process for producting a grinding agent carrier comprised of a carrier body and a layer of grinding agent on the surface of the carrier body, the grinding agent layer being initially produced on a planar substrate by sedimentation from a suspension comprised of a suspension medium and grinding agent and then transferred from the substrate and bonded to the carrier body, the improvement wherein the substrate is maintained in a horizontal position and the sedimentation is effected on the horizontal substrate from a liquid column of the suspension wherein the liquid column is merely constituted by a puddle.

* * * * *

UNITED STATES PATENT AND TRADEMARK OFFICE

CERTIFICATE OF CORRECTION

PATENT NO. : 4,133,145

DATED : January 9th, 1979

INVENTOR(S) : Günter Joschko et al

It is certified that error appears in the above-identified patent and that said Letters Patent are hereby corrected as shown below:

In the heading of the patent, insert:
--[30] Foreign Application Priority Data

Dec. 16, 1975 Fed. Rep. of Germany....2556504--

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*